US011437722B2

(12) United States Patent
Wu et al.

(10) Patent No.: US 11,437,722 B2
(45) Date of Patent: Sep. 6, 2022

(54) COMPACT MULTI-BAND AND DUAL-POLARIZED RADIATING ELEMENTS FOR BASE STATION ANTENNAS

(71) Applicant: CommScope Technologies LLC, Hickory, NC (US)

(72) Inventors: Bo Wu, Suzhou (CN); Peter J. Bisiules, LaGrange Park, IL (US); Ligang Wu, Suzhou (CN); Hangsheng Wen, Suzhou (CN); Yuemin Li, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 162 days.

(21) Appl. No.: 16/875,324

(22) Filed: May 15, 2020

(65) Prior Publication Data

US 2020/0373668 A1 Nov. 26, 2020

(30) Foreign Application Priority Data

May 23, 2019 (CN) ..... 201910432996.6

(51) Int. Cl.
*H01Q 5/314* (2015.01)
*H01Q 21/26* (2006.01)
(Continued)

(52) U.S. Cl.
CPC ..... *H01Q 5/314* (2015.01); *H01Q 1/24* (2013.01); *H01Q 1/246* (2013.01); *H01Q 9/285* (2013.01);
(Continued)

(58) Field of Classification Search
CPC ..... H01Q 5/314; H01Q 1/246; H01Q 21/26; H01Q 5/00; H01Q 1/24; H01Q 9/285; H01Q 21/30; H01Q 25/001
See application file for complete search history.

(56) References Cited

U.S. PATENT DOCUMENTS

2005/0116869 A1* 6/2005 Siegler ..... H01Q 1/36 343/749
2008/0238800 A1* 10/2008 Collins ..... H01Q 23/00 343/795
(Continued)

*Primary Examiner* — Hai V Tran
(74) *Attorney, Agent, or Firm* — Myers Bigel, P.A.

(57) ABSTRACT

Multi-band antennas utilize compact multi-band dipole-type radiating elements having multiple arms, including a front facing arm and a rear facing arm that respectively target higher and lower frequency bands. These higher and lower frequency bands may include, but are not limited to, a relatively wide band (e.g., 1695-2690 MHz) associated with the front facing arm and somewhat narrower and nonoverlapping band (e.g., 1427-1518 MHz) associated with the rear facing arm. The front facing arm may extend on a "front" layer of a multi-layer printed circuit board and the rear facing arm may extend at least partially on a "rear" layer of the printed circuit board. A resonant LC (or CLC) network is provided, which is integrated into the rear facing arm and at least capacitively coupled to the front facing arm. This resonant network advantageously supports low-pass filtering from the front facing arm to the rear facing arm, to thereby support the multiple and nonoverlapping bands.

10 Claims, 13 Drawing Sheets

(51) Int. Cl.

| | |
|---|---|
| ***H01Q 1/24*** | (2006.01) |
| ***H01Q 9/28*** | (2006.01) |
| ***H01Q 25/00*** | (2006.01) |
| ***H01Q 21/30*** | (2006.01) |

(52) U.S. Cl.
CPC ..... *H01Q 21/26* (2013.01); *H01Q 21/30* (2013.01); *H01Q 25/001* (2013.01)

(56) References Cited

U.S. PATENT DOCUMENTS

| | | | | |
|---|---|---|---|---|
| 2011/0291894 | A1* | 12/2011 | Qi | H01Q 5/40 343/700 MS |
| 2013/0249753 | A1* | 9/2013 | Asanuma | H01Q 9/28 343/749 |
| 2014/0139387 | A1* | 5/2014 | Jones | H01Q 19/30 343/794 |
| 2018/0323513 | A1 | 11/2018 | Varnoosfaderani et al. | |
| 2020/0127389 | A1 | 4/2020 | Li et al. | |

* cited by examiner

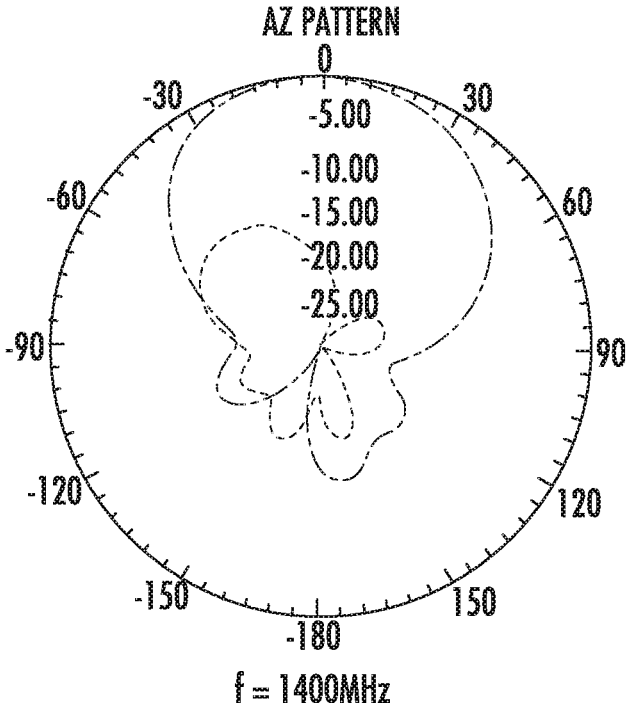
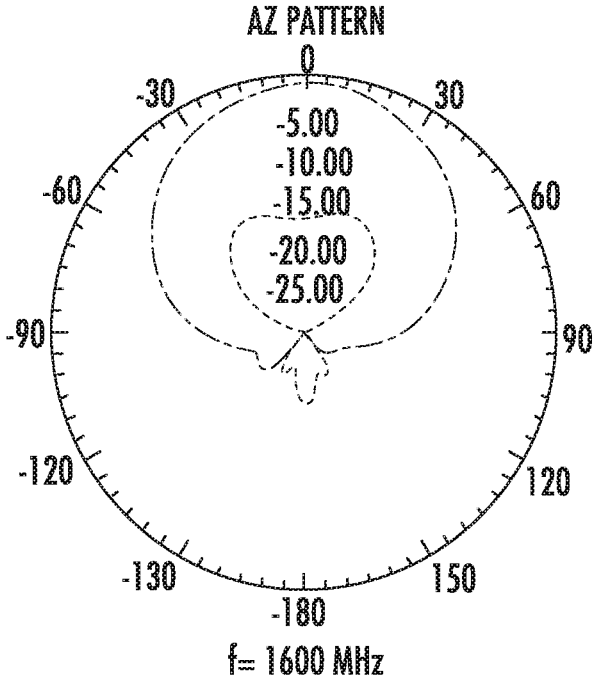
FIG. 7A
| FIG. 7A | FIG. 7B |
|---|---|
FIG. 7 f = 2045MHz f = 2690MHz

COMPACT MULTI-BAND AND DUAL-POLARIZED RADIATING ELEMENTS FOR BASE STATION ANTENNAS

CROSS-REFERENCE TO PRIORITY APPLICATION

The present application claims priority to Chinese Patent Application No. 201910432996.6, filed May 23, 2019, the entire content of which is incorporated herein by reference.

BACKGROUND

The present invention generally relates to radio communications and, more particularly, to base station antennas for cellular communications systems.

Cellular communications systems are well known in the art. In a cellular communications system, a geographic area is divided into a series of regions that are referred to as "cells" which are served by respective base stations. The base station may include one or more antennas that are configured to provide two-way radio frequency ("RF") communications with mobile subscribers that are within the cell served by the base station. In many cases, each base station is divided into "sectors." In one common configuration, a hexagonally shaped cell is divided into three 120° sectors in the azimuth plane, and each sector is served by one or more base station antennas that have an azimuth Half Power Beamwidth ("HPBW") of approximately 65° to provide coverage to the full 120° sector. Typically, the base station antennas are mounted on a tower or other raised structure, with the radiation patterns (also referred to herein as "antenna beams") that are generated by the base station antennas directed outwardly. Base station antennas are often implemented as linear or planar phased arrays of radiating elements.

In order to accommodate the increasing volume of cellular communications, cellular operators have added cellular service in a variety of new frequency bands. While in some cases it is possible to use a single linear array of so-called "wide-band" radiating elements to provide service in multiple frequency bands, in other cases it is necessary to use different linear arrays (or planar arrays) of radiating elements to support service in the different frequency bands.

As the number of frequency bands has proliferated, and increased sectorization has become more common (e.g., dividing a cell into six, nine or even twelve sectors), the number of base station antennas deployed at a typical base station has increased significantly. However, due to, for example, local zoning ordinances and/or weight and wind loading constraints for the antenna towers, there is often a limit as to the number of base station antennas that can be deployed at a given base station. In order to increase capacity without further increasing the number of base station antennas, so-called multi-band base station antennas have been introduced which include multiple arrays of radiating elements that operate in different frequency bands. One common multi-band base station antenna design includes two linear arrays of "low-band" radiating elements that are used to provide service in some or all of the 694-960 MHz frequency band and two linear arrays of "mid-band" radiating elements that are used to provide service in some or all of the 1427-2690 MHz frequency band. These linear arrays are typically mounted in side-by-side fashion.

For example, a number of dual-polarized antennas have been developed for 2G/3G/4G/LTE systems operating in the 2 GHz band (1.695-2.690 GHz). More recently, the 1.4/1.5 GHz band (1427-1518 MHz) is of value to international mobile telecommunications (IMT) services because it provides much needed capacity to support traffic growth and has propagation characteristics that support better rural and in-building coverage. Indeed, Japan already uses the 1427-1518 MHz band for IMT services. In Europe, the 28 countries of the European Union support 1452-1492 MHz and a number of states also support identification of the 1427-1518 MHz band. As candidate frequency bands, Europe may use the 1427-1452 MHz and 1452-1492 MHz bands, whereas the United States supports the 1695-2690 MHz band for 5G mobile communications. Therefore, to realize global harmonization, it would be advantageous to develop dual-polarized antennas that can cover the 1.4/1.5 GHz band (targeting for IMT) as well as the 2 GHz band (targeting for LTE). In addition, there is also interest in deploying base station antennas that further include one or more linear arrays of "high-band" radiating elements that operate in higher frequency bands, such as the 3.3-4.2 GHz frequency band.

SUMMARY

Multi-band antennas according to embodiments of the invention utilize a compact multi-band dipole-type radiating element having multiple arms, including a front facing arm and a rear facing arm that respectively target higher and lower frequency bands, with lower return loss resulting from greater front-to-rear arm independence and improved column-to-column isolation across multiple bands and different polarizations. These higher and lower frequency bands may include, but are not limited to, a relatively wide band (e.g., 1695-2690 MHz) associated with the front facing arm and somewhat narrower and nonoverlapping band (e.g., 1427-1518 MHz) associated with the rear facing arm, which operates as a dipole arm extension. According to some of these embodiments of the invention, the front facing arm may be configured on a front facing "top" layer of a multi-layer printed circuit board (PCB) and the rear facing arm may be configured to include a resonant LC (or CLC) circuit, which is located, at least partially, on a rear facing "bottom" layer of the multi-layer printed circuit board. The front and rear facing layers can be configured as patterned metallization (e.g., copper) layers that partially overlap to provide capacitive coupling therebetween, which advantageously supports low-pass filtering operations associated with the resonant circuit.

According to additional embodiments of the invention, a multi-band radiating element is provided with at least a first dipole-type radiator having first and second "front facing" dipole arms, which extend adjacent opposite ends thereof. These first and second dipole arms are "loaded" at opposing distal ends thereof by respective first and second resonant circuits, which are at least capacitively-coupled to respective ones of the first and second dipole arms. Preferably, the first and second dipole arms are configured to resonate at a first frequency within a first frequency band (e.g., 1695-2690 MHz), and the first and second resonant circuits are configured as low pass filters that preferentially block signals at the first frequency (and within the first frequency band) yet passes signals within a second frequency band (e.g., 1427-1518 MHz) to "rear facing" dipole arms, which operate as dipole arm extensions. In some of these embodiments of the invention, the first and second resonant circuits are each configured as a respective LC networks having a first terminal capacitively-coupled to a corresponding one of the first and second dipole arms and a second terminal directly connected to a corresponding one of the first and second dipole arms. Alternatively, each of the first and second resonant circuits may include a CLC network having first and second terminals capacitively-coupled to a corresponding one of the first and second dipole arms.

According to additional embodiments of the invention, the first dipole-type radiator includes a multi-layer printed circuit board, with the first and second "front facing" dipole arms including patterned metallization on a first side of the multi-layer printed circuit board, and each of the first and second resonant circuits including patterned metallization in the form of "rear facing" dipole arms on a second side of the multi-layer printed circuit board. In some of these embodiments of the invention, a portion of the patterned metallization associated with the first resonant circuit extends opposite a corresponding portion of the patterned metallization associated with the first dipole arm to thereby define a first capacitor of the first resonant circuit. Similarly, a portion of the patterned metallization associated with the second resonant circuit extends opposite a corresponding portion of the patterned metallization associated with the second dipole arm to thereby define a second capacitor of the second resonant circuit. In addition, each of the first and second resonant circuits may include patterned metallization in the form of an inductor on the first side of the multi-layer printed circuit board. The multi-layer printed circuit board may also include: (i) a first plated through-hole therein, which electrically connects a terminal of the inductor associated with the first resonant circuit to a first portion of the patterned metallization on the second side of multi-layer printed circuit board, and (ii) a second plated through-hole therein, which electrically connects a terminal of the inductor associated with the second resonant circuit to a second portion of the patterned metallization on the second side of multi-layer printed circuit board.

A multi-band radiating element according to additional embodiments of the invention can include a first dipole-type radiator having first and second dipole arms that are loaded at opposing distal ends thereof by respective first and second resonant circuits, which are configured as low pass filters relative to a resonant frequency associated with the first and second dipole arms. In some of these embodiments of the invention, the first and second resonant circuits are configured to include LC networks or CLC networks therein. In addition, the first dipole-type radiator may include a multi-layer printed circuit board, with the first and second dipole arms including patterned metallization on a first side of the multi-layer printed circuit board, and with each of the first and second resonant circuits including patterned metallization on a second side of the multi-layer printed circuit board, which overlaps at least partially with the patterned metallization on the first side of the multi-layer printed circuit board. The LC network (or CLC network) associated with each resonant circuit may further include an inductor (L) defined by at least one patterned trace on the first side of the multi-layer printed circuit board. Each LC network may also be configured as a pair of equivalent LC networks, which are electrically coupled in parallel.

According to another embodiment of the invention, a multi-band radiating element includes a first dipole-type radiator configured using a multi-layer printed circuit board, a first dipole arm on a front side of the printed circuit board, a second dipole arm on a rear side of the printed circuit board, and a low pass filter electrically coupling the first dipole arm to the second dipole arm. In some of these embodiments of the invention, the low pass filter may include an inductor on the front side of the printed circuit board, and at least one capacitor electrode on the rear side of the printed circuit board, which may be defined by a portion of the second dipole arm. The printed circuit board may also have a plated through-hole therein that electrically connects the inductor to the at least one capacitor electrode. In some of these embodiments of the invention, the low pass filter may be configured as an LC network, or as a CLC network, which may be treated herein as a combination of a CL network and an LC network.

According to still further embodiments of the invention, multiple ones of the multi-band dipole-type radiating elements described and illustrated herein may be utilized within corresponding pairs of dipole-type radiating elements, which are arranged in a cross-polarization type configuration and spaced apart from other pairs to thereby define a multi-band antenna array that is suitable for use in a base station antenna. In addition, the multi-band dipole-type radiating elements described herein may be modified to operate across three or more frequency bands by patterning additional rear facing "bottom" arms for each of the additional frequency bands.

DETAILED DESCRIPTION

Figure 1:
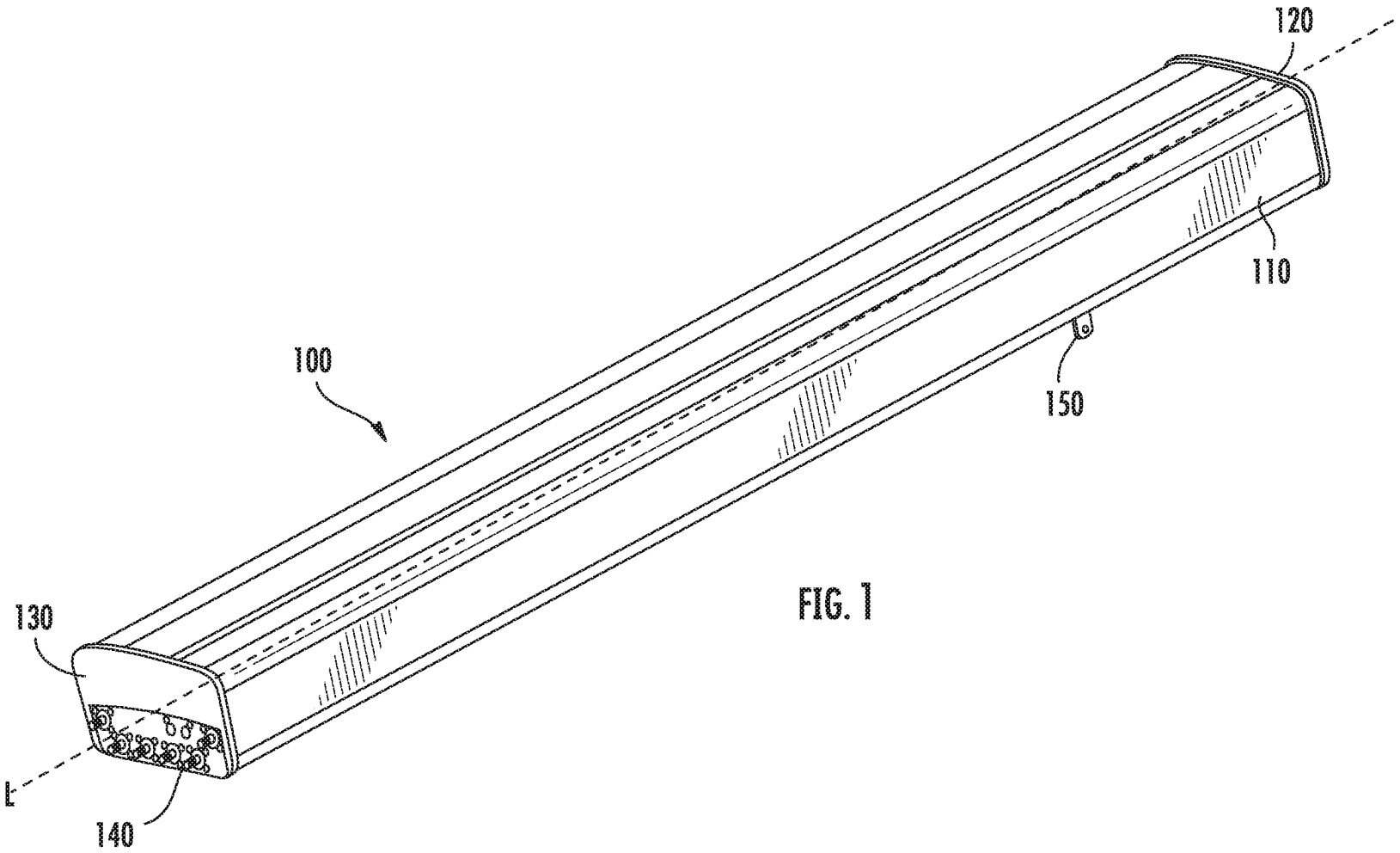
FIG. 1 is a perspective view of a base station antenna according to embodiments of the present invention.

Embodiments of the present invention relate generally to radiating elements for a multi-band base station antenna and to related base station antennas. The multi-band base station antennas according to embodiments of the present invention may support two or more major air-interface standards in two or more cellular frequency bands and allow wireless operators to reduce the number of antennas deployed at base stations, lowering tower leasing costs while increasing speed to market capability.

One challenge in the design of multi-band base station antennas is reducing the effect of scattering of the RF signals at one frequency band by the radiating elements of other frequency bands. Scattering is undesirable as it may affect the shape of the antenna beam in both the azimuth and elevation planes, and the effects may vary significantly with frequency, which may make it hard to compensate for these effects. Moreover, at least in the azimuth plane, scattering tends to impact one or more of the beamwidth, beam shape, pointing angle, gain and front-to-back ratio in undesirable ways.

In order to reduce scattering, broadband decoupling radiating elements have been developed that may transmit and receive RF signals in a first frequency band (e.g., low band) while being substantially transparent to RF signals in a second frequency band (e.g., mid band). For example, U.S. Provisional Patent Application Ser. No. 62/500,607, filed May 3, 2017, discloses a multi-band antenna that includes linear arrays of both low-band and mid-band cross-dipole radiating elements. The low-band cross-dipole radiating elements have dipole arms that each include a plurality of widened sections that are connected by intervening narrowed sections. The narrowed trace sections may be designed to act as high impedance sections that are designed to interrupt currents in the operating frequency band of the mid-band radiating elements that could otherwise be induced on dipole arms of the low-band radiating elements. The narrowed trace sections may be designed to create this high impedance for currents in the operating frequency band of the mid-band radiating elements, but without significantly impacting the ability of the low-band currents to flow on the dipole arms. As a result, the low-band radiating elements may be substantially transparent to the mid-band radiating elements, and hence may have little or no impact on the antenna beams formed by the mid-band radiating elements. The narrowed sections may act like inductive sections. In fact, in some embodiments, the narrowed trace sections may be replaced with lumped inductances such as chip inductors, coils and the like or other printed circuit board structures (e.g., solenoids) that act like inductors. The narrowed trace sections (or other inductive elements), however, may increase the impedance of the low-band dipole radiators, which may reduce the operating bandwidth of the low-band radiating elements.

In addition, as disclosed herein and in U.S. Provisional Patent Application Ser. No. 62/797,667, filed Jan. 28, 2019, the disclosure of which is hereby incorporated herein by reference, multi-resonance dipole radiating elements have been developed that exhibit increased operating bandwidth as compared to conventional dipole radiating elements. Each dipole radiator in these radiating elements may include two (or more) pairs of dipole arms, with each pair of dipole arms configured to resonate at a different frequency. By designing the dipole radiators to radiate at two or more different resonant frequencies, the operating bandwidth for the radiating element may be increased. For example, the disclosed multi-resonance dipole radiating element, which is configured to operate in a frequency band having a center frequency of $f_c$, is designed so that one pair of dipole arms radiates at a frequency within the operating frequency band that is below $f_c$, while another one of the dipole arm pairs radiates at a frequency within the operating frequency band that is above $f_c$. The result is that the operating bandwidth of the multi-resonance dipole radiating element may be increased as compared to a single resonance dipole radiating element. These radiating elements may be used, for example, in multi-band antennas, and may be particularly useful in multi-band antennas that include radiating elements that are designed to pass currents in a first frequency band (e.g., low-band) while being substantially transparent to currents in a higher second frequency band (e.g., mid-band).

Embodiments of the present invention will now be described in further detail with reference to the attached figures.

Figure 2:
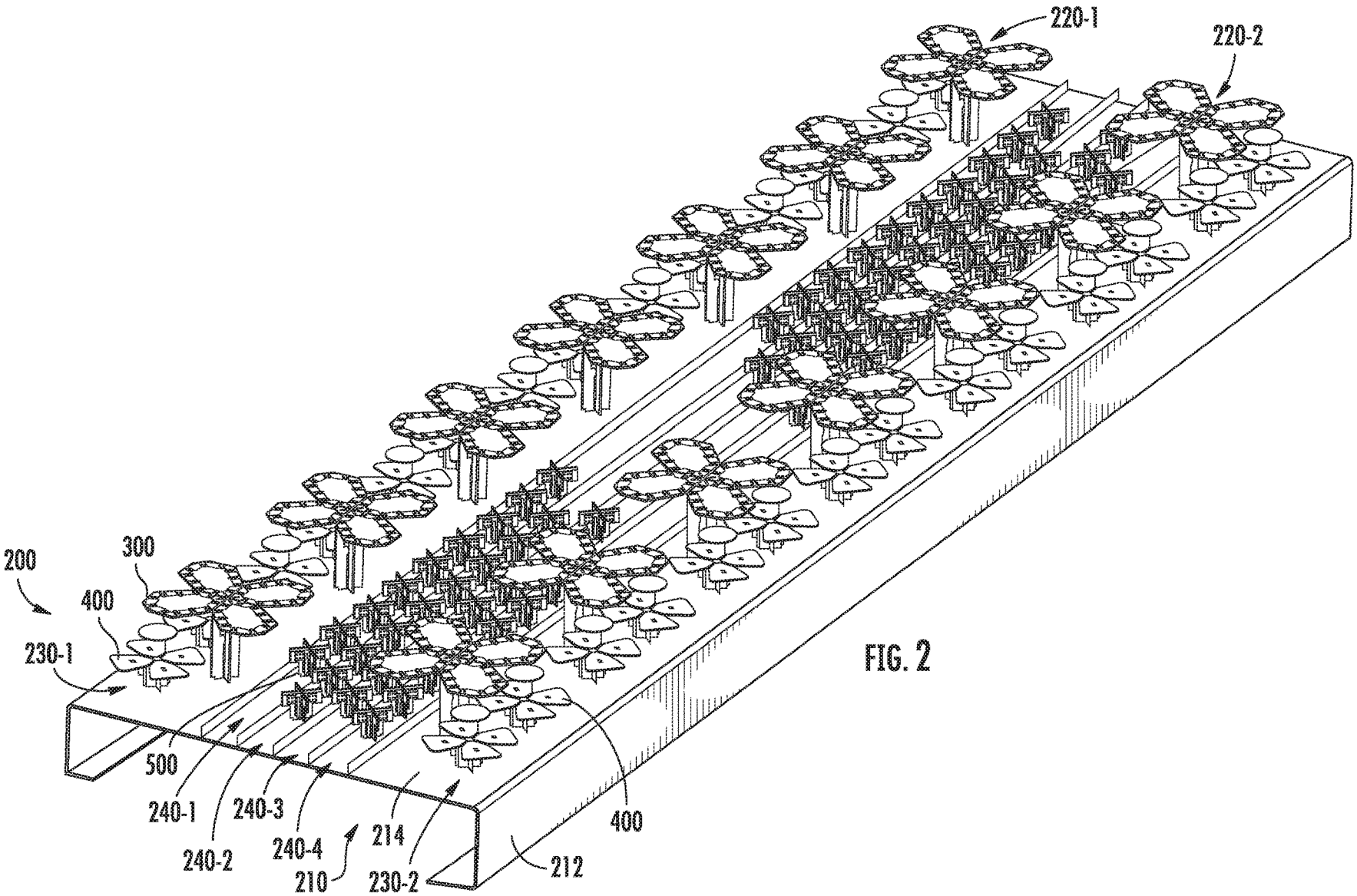
FIG. 2 is a perspective view of the base station antenna of FIG. 1 with the radome removed.
Figure 3:
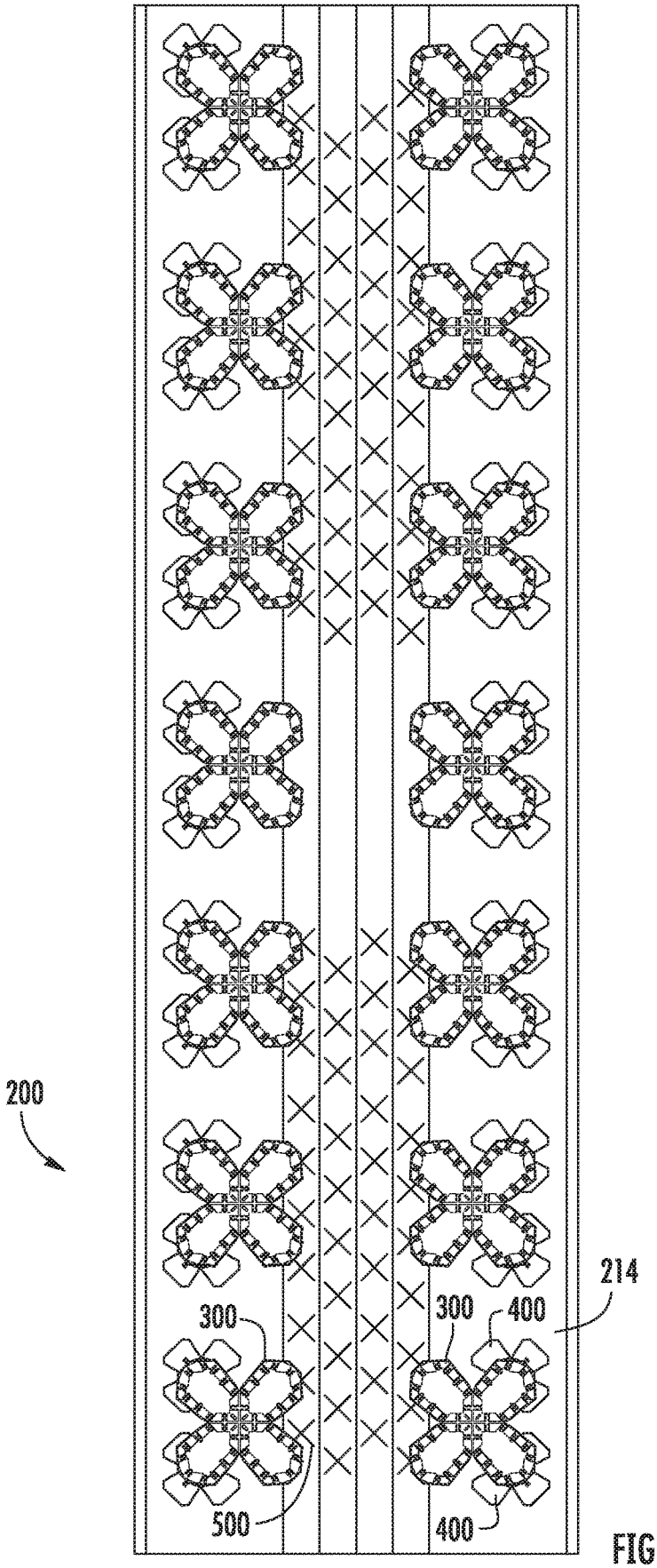
FIG. 3 is a front view of the base station antenna of FIG. 1 with the radome removed.
Figure 4:
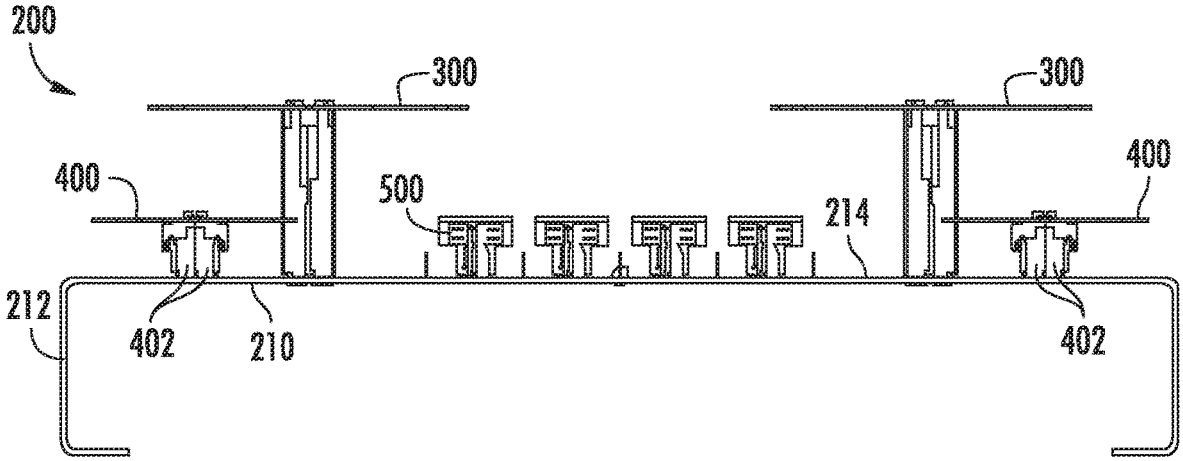
FIG. 4 is a cross-sectional view of the base station antenna of FIG. 1 with the radome removed.

FIGS. 1-4 illustrate a base station antenna 100 according to certain embodiments of the present invention. In particular, FIG. 1 is a perspective view of the antenna 100, while FIGS. 2-4 are perspective, front and cross-sectional views, respectively, of the antenna 100 with the radome thereof removed to illustrate the antenna assembly 200 of the antenna 100.

As shown in FIGS. 1-4, the base station antenna 100 is an elongated structure that extends along a longitudinal axis L. The base station antenna 100 may have a tubular shape with a generally rectangular cross-section. The antenna 100 includes a radome 110 and a top end cap 120. In some embodiments, the radome 110 and the top end cap 120 may comprise a single integral unit, which may be helpful for waterproofing the antenna 100. One or more mounting brackets 150 are provided on the rear side of the antenna 100 which may be used to mount the antenna 100 onto an antenna mount (not shown) on, for example, an antenna tower. The antenna 100 also includes a bottom end cap 130 which includes a plurality of connectors 140 mounted therein. The antenna 100 is typically mounted in a vertical configuration (i.e., the longitudinal axis L may be generally perpendicular to a plane defined by the horizon) when the antenna 100 is mounted for normal operation. The radome 110, top cap 120 and bottom cap 130 may form an external housing for the antenna 100. An antenna assembly 200 is contained within the housing. The antenna assembly 200 may be slidably inserted into the radome 110.

As shown in FIGS. 2-4, the antenna assembly 200 includes a ground plane structure 210 that has sidewalls 212 and a reflector surface 214. Various mechanical and electronic components of the antenna (not shown) may be mounted in the chamber defined between the sidewalls 212 and the back side of the reflector surface 214 such as, for example, phase shifters, remote electronic tilt units, mechanical linkages, a controller, diplexers, and the like. The reflector surface 214 of the ground plane structure 210 may comprise or include a metallic surface that serves as a reflector and ground plane for the radiating elements of the antenna 100. Herein the reflector surface 214 may also be referred to as the reflector 214.

A plurality of dual-polarized radiating elements 300, 400, 500 are mounted to extend forwardly from the reflector surface 214 of the ground plane structure 210. The radiating elements include low-band radiating elements 300, which may be configured as disclosed in the aforementioned U.S. Provisional Patent Application Ser. No. 62/797,667, mid-band radiating elements 400, which are described more fully hereinbelow, and high-band radiating elements 500. As shown, the low-band radiating elements 300 are mounted in two columns to form two linear arrays 220-1, 220-2 of low-band radiating elements 300. Each low-band linear array 220 may extend along substantially the full length of the antenna 100.

The mid-band radiating elements 400 may likewise be mounted in two columns to form two linear arrays 230-1, 230-2 of mid-band radiating elements 400. The high-band radiating elements 500 are shown as mounted in four columns to form four linear arrays 240-1 through 240-4 of high-band radiating elements 500. In other embodiments, the number of linear arrays of low-band, mid-band and/or high-band radiating elements may be varied from those shown in FIGS. 2-4. It should be noted herein that like elements may be referred to individually by their full reference numeral (e.g., linear array 230-2) and may be referred to collectively by the first part of their reference numeral (e.g., the linear arrays 230).

In the depicted embodiment, the linear arrays 240 of high-band radiating elements 500 are positioned between the linear arrays 220 of low-band radiating elements 300, and each linear array 220 of low-band radiating elements 300 is positioned between a respective one of the linear arrays 240 of high-band radiating elements 500 and a respective one of the linear arrays 230 of mid-band radiating elements 400. The linear arrays 230 of mid-band radiating elements 400 may or may not extend the full length of the antenna 100, and the linear arrays 240 of high-band radiating elements 500 may or may not extend the full length of the antenna 100.

The low-band radiating elements 300 may be configured to transmit and receive signals in a first frequency band, which may include a 617-960 MHz frequency range or a portion thereof (e.g., the 617-806 MHz frequency band, the 694-960 MHz frequency band, etc.). The mid-band radiating elements 400 may be configured to transmit and receive signals in a pair of non-overlapping mid-frequency bands, such as, for example a 1427-1518 MHz band and a 1695-2690 MHz band, as described more fully hereinbelow. And, the high-band radiating elements 500 may be configured to transmit and receive signals in a third frequency band, such as a high frequency band including a 3300-4200 MHz frequency range (or a portion thereof). The low-band, mid-band and high-band radiating elements 300, 400, 500 may each be mounted to extend forwardly from the ground plane structure 210.

As shown, the low-band radiating elements 300 are arranged as two low-band arrays 220 of dual-polarized radiating elements, and each low-band array 220-1, 220-2 may be used to form a pair of antenna beams, namely an antenna for each of the two polarizations at which the dual-polarized radiating elements 300 are designed to transmit and receive RF signals. Each radiating element 300 in the first low-band array 220-1 may be horizontally aligned with a respective radiating element 300 in the second low-band array 220-2. Likewise, each radiating element 400 in the first mid-band array 230-1 may be horizontally aligned with a respective radiating element 400 in the second mid-band array 230-2. While not shown in the figures, the radiating elements 300, 400, 500 may be mounted on feed boards that couple RF signals to and from the individual radiating elements 300, 400, 500. One or more radiating elements 300, 400, 500 may be mounted on each feed board. Cables may be used to connect each feed board to other components of the antenna such as diplexers, phase shifters or the like.

While cellular network operators are interested in deploying antennas that have a large number of linear arrays of radiating elements in order to reduce the number of base station antennas required per base station, increasing the number of linear arrays typically increases the width of the antenna. Both the weight of a base station antenna and the wind loading the antenna will experience increase with increasing width, and thus wider base station antennas tend to require structurally more robust antenna mounts and antenna towers, both of which can significantly increase the cost of a base station. Accordingly, cellular network operators typically want to limit the width of a base station antenna to be less than 500 mm, and more preferably, to less than 440 mm (or in some cases, less than 400 mm). This can be challenging in base station antennas that include two linear arrays of low-band radiating elements, since most conventional low-band radiating elements that are designed to serve a 120° sector have a width of about 200 mm or more.

The width of a multi-band base station antenna may be reduced by decreasing the separation between adjacent linear arrays. Thus, in antenna 100, the low-band radiating elements 300 may be located in very close proximity to both the mid-band radiating elements 400 and the high-band radiating elements 500. As can be seen in FIGS. 2-4, the low-band radiating elements 300 extend farther forwardly from the reflector 214 than do both the mid-band radiating elements 400 and the high-band radiating elements 500. In the depicted embodiment, each low-band radiating element 300 that is adjacent a linear array 230 of mid-band radiating elements 400 may horizontally overlap a substantial portion of two of the mid-band radiating elements 400. The term "horizontally overlap" is used herein to refer to a specific positional relationship between first and second radiating elements that extend forwardly from a reflector of a base station antenna. In particular, a first radiating element is considered to "horizontally overlap" a second radiating element if an imaginary line can be drawn that is normal to the front surface of the reflector that passes through both the first radiating element and the second radiating element. Likewise, each low-band radiating element 300 that is adjacent a linear array 240 of high-band radiating elements 500 may horizontally overlap at least a portion of one or more of the high-band radiating elements 500. Allowing the radiating elements to horizontally overlap allows for a significant reduction in the width of the base station antenna 100.

Unfortunately, when the separation between adjacent linear arrays is reduced, increased coupling between radiating elements of the linear arrays occurs, and this increased coupling may impact the shapes of the antenna beams generated by the linear arrays in undesirable ways. For example, a low-band cross-dipole radiating element will typically have dipole radiators that have a length that is approximately one-third (⅓) to one (1) wavelength of the operating frequency. Each dipole radiator is typically implemented as a pair of center-fed dipole arms. If the low-band radiating element is designed to operate in the 700 MHz frequency band, and the mid-band radiating elements are designed to operate in the 1400 MHz frequency band, the length of the low-band dipole radiators ($\lambda/2$) will be approximately one wavelength ($\lambda$) at the mid-band operating frequency. As a result, each dipole arm of a low-band dipole radiator will have a length that is approximately ½ a wavelength at the mid-band operating frequency, and hence RF energy transmitted by the mid-band radiating elements will tend to couple to the low-band radiating elements. This coupling can distort the antenna patterns of the linear arrays 230-1, 230-2 of the mid-band radiating elements 400. Similar distortion can occur if RF energy emitted by the high-band radiating elements couples to the low-band radiating elements.

Thus, while positioning the low-band radiating elements 300 so that they horizontally overlap the mid-band and/or the high-band radiating elements 400, 500 may advantageously facilitate reducing the width of the base station antenna 100, this approach may significantly increase the coupling of RF energy transmitted by the mid-band and/or the high-band radiating elements 400, 500 onto the low-band radiating elements 300, and such coupling may degrade the antenna patterns formed by the linear arrays 230, 240 of mid-band and/or high-band radiating elements 400, 500. Nonetheless, to reduce the degree of coupling of RF energy from the mid-band and/or high-band radiating elements 400, 500 onto the low-band radiating elements 300, the low-band radiating elements 300 may be configured to be substantially transparent to the mid-band radiating elements 400 or to the high-band radiating elements 500, as described in the aforementioned U.S. Provisional Application Ser. No. 62/797,667.

Figure 5A:
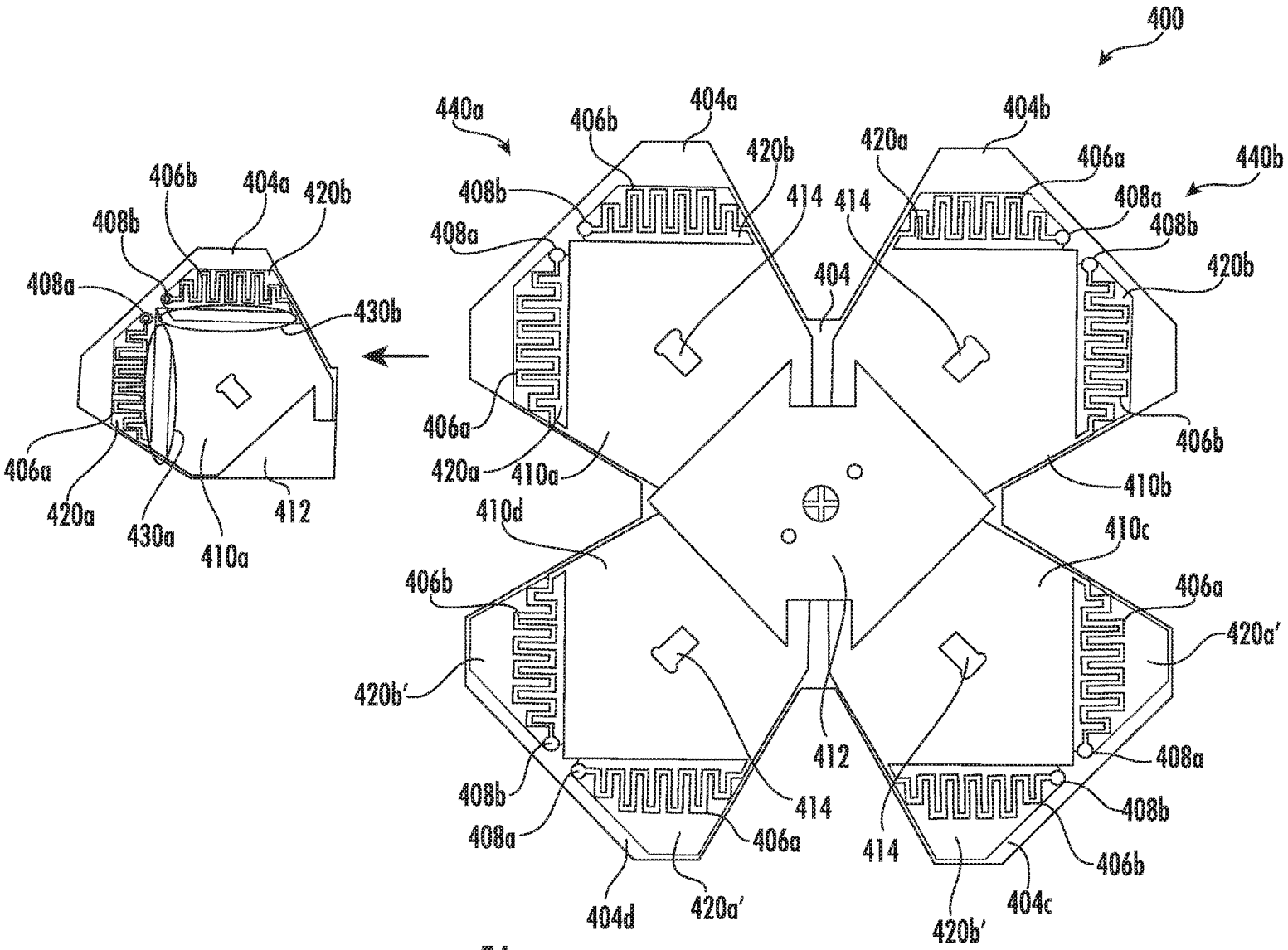
FIGS. 5A-5B are respective front and front perspective views of a mid-band radiating element including a pair of cross-polarized dipole radiators, according to embodiments of the present invention.
Figure 5B:
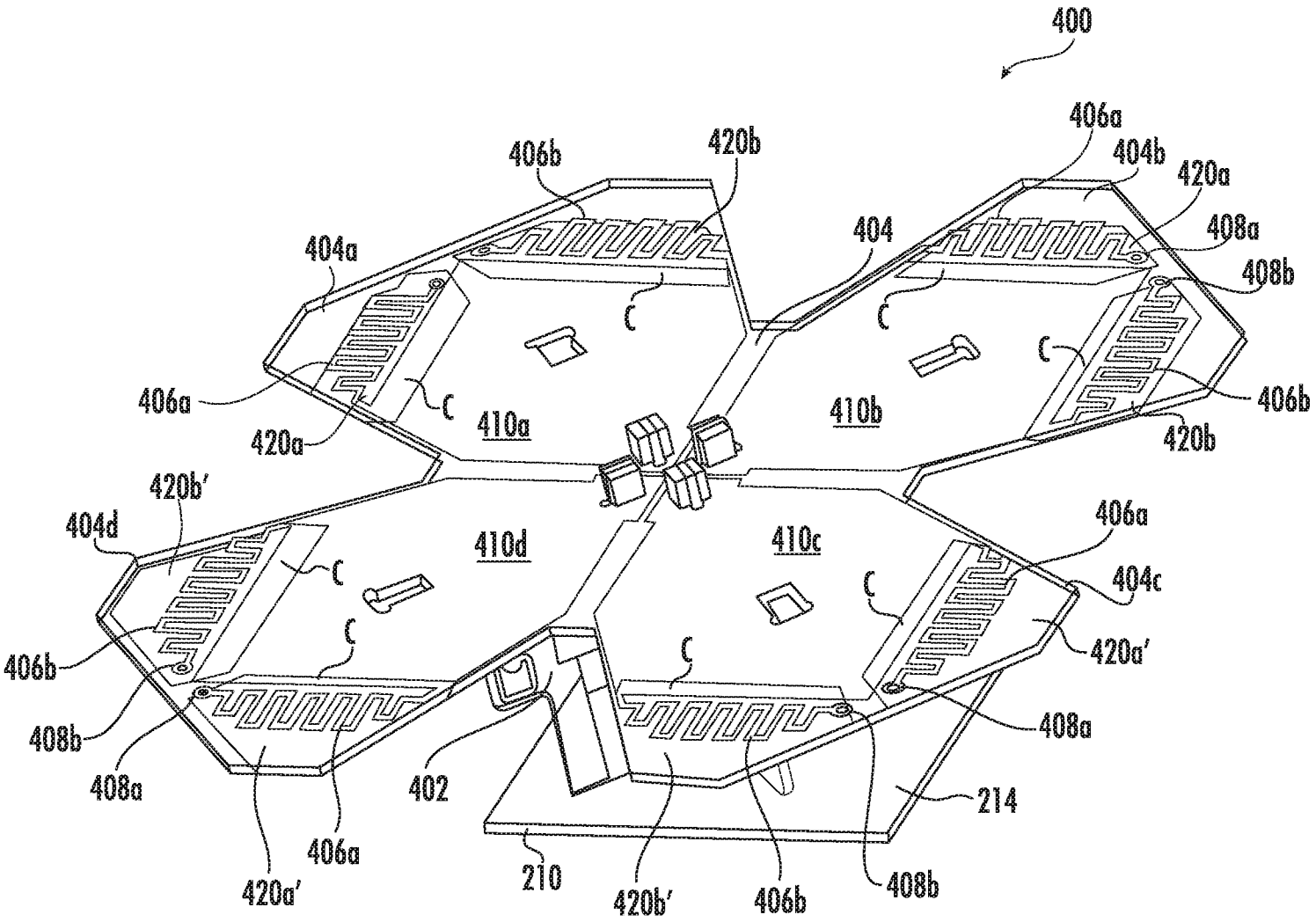
Figure 5C:
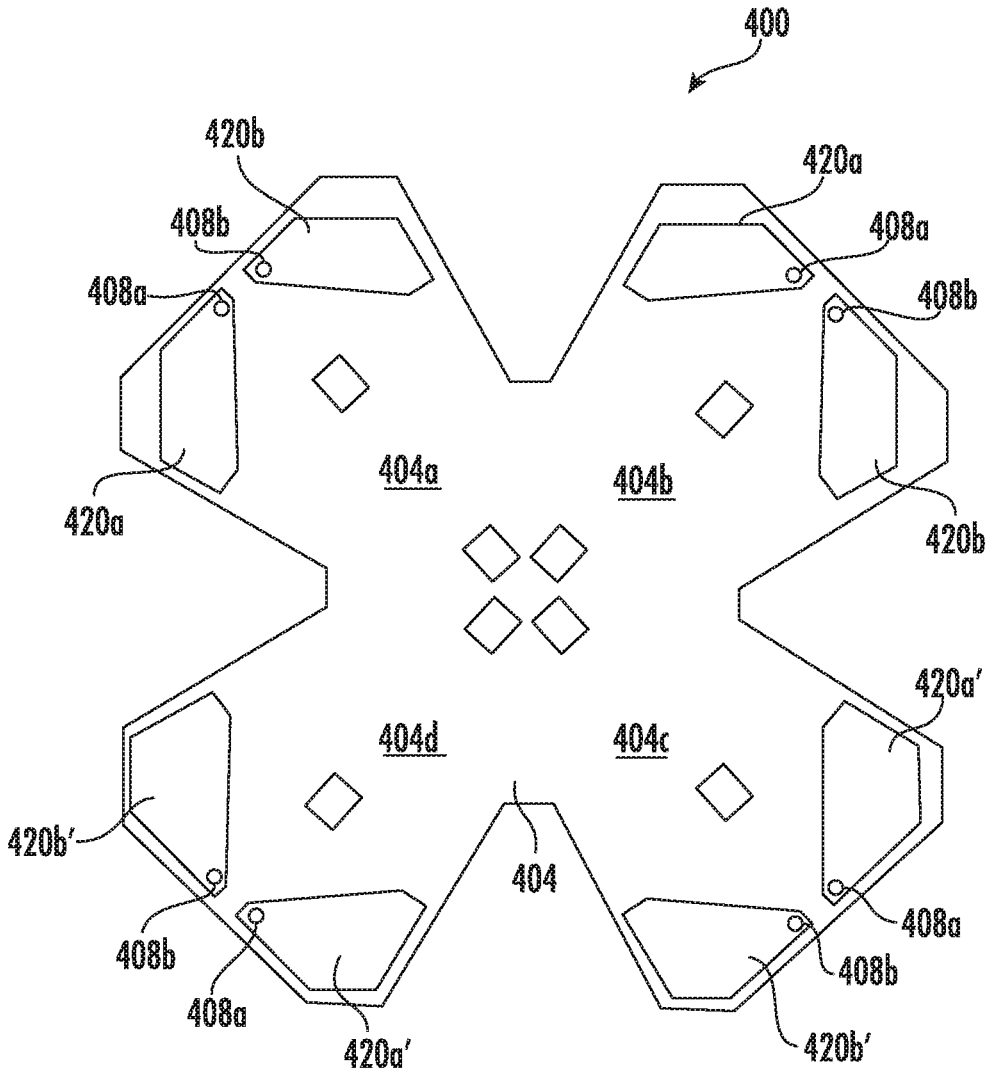
FIG. 5C is a front view of the printed circuit board of FIG. 5A, but with front side metallization removed and rear side metallization highlighted to illustrate placement and dimensions of four pairs of dipole arm extensions located on a rear side of the printed circuit board, according to an embodiment of the invention.

Referring now to FIGS. 5A-5C, an embodiment of a mid-band (and multi-band) radiating element 400, which can be advantageously utilized within the base station antenna (BSA) 100 and antenna assembly 200 of FIGS. 1-4, is illustrated as including a multi-layer printed circuit board (PCB) 404, which is dimensioned to operate as a pair of cross-polarized (e.g., +45°, −45°) dipole radiators, which are supported in front of a ground plane 210 and reflector surface 214 by a pair of feed stalks 402. (See, e.g., FIGS. 4 and 5B). The multi-layer PCB 404 includes a first dipole radiator 440*a* that spans opposing dielectric board segments 404*a*, 404*c* and a second dipole radiator 440*b* that spans opposing dielectric board segments 404*b*, 404*d*. These cross-polarized dipole radiators 440*a*, 440*b* may be partially covered by a radiation director 412 (to support beamwidth narrowing), as illustrated by FIG. 5A and as schematically shown in FIG. 2, but omitted from FIG. 5B for purposes of clarity.

As shown, the opposing board segments 404*a*, 404*c* of the first dipole radiator 440*a* include patterned metallization (e.g., copper) on the front side of the board segments 404*a*, 404*c* and patterned metallization (e.g., copper) on the rear side of the board segments 404*a*, 404*c*, which face the reflector surface 214. The patterned metallization on the front side of the board segments 404*a*, 404*c* includes first and second polygonal-shaped dipole arms 410*a*, 410*c* having openings 414 therein, which extend completely through the PCB 404. The patterned metallization on the rear side of the board segments 404*a*, 404*c* includes a first pair of spaced-apart and polygonal-shaped dipole arms 420*a*, 420*b* having equivalent dimensions, and a second pair of spaced-apart and somewhat larger polygonal-shaped dipole arms 420*a*', 420*b*', which can inhibit beam squint when the PCB 404 is located adjacent an edge of an underlying reflector surface 214. As described herein and illustrated best by FIG. 5C, these pair of dipole arms 420*a*, 420*b*, and 420*a*', 420*b*' on the rear side of the PCB 404 function as dipole arm extensions relative to the first and second dipole arms 410*a*, 410*c*.

As shown, the first pair of spaced-apart and rear facing dipole arms 420*a*, 420*b* extend adjacent a distal end of the board segment 404*a* and the second pair of spaced-apart and rear facing dipole arms 420*a*', 420*b*' extend adjacent a distal end of the opposing board segment 404*c*. In addition, each of the rear facing dipole arms 420*a*, 420*b* extends opposite a corresponding and equivalent serpentine-shaped inductor 406*a*, 406*b*. Each of these inductors 406*a*, 406*b* is: (i) patterned on the front side of the board segment 404*a*, (ii) directly coupled (e.g., electrically shorted) via a short metal segment to a corresponding side of the first dipole arm 410*a*, as shown, and (iii) directly coupled by a corresponding plated through-hole 408*a*, 408*b* to an underlying one of the rear facing dipole arms 420*a*, 420*b*. Likewise, each of the rear facing dipole arms 420*a*', 420*b*' extends opposite a corresponding and equivalent serpentine-shaped inductor 406*a*, 406*b*. Each of these inductors 406*a*, 406*b* is: (i) patterned on the front side of the board segment 404*c*, (ii) directly coupled (e.g., electrically shorted) via a short metal segment to a corresponding side of the second dipole arm 410*c*, as shown, and (iii) directly coupled by a corresponding plated through-hole 408*a*, 408*b* to an underlying one of the rear facing dipole arms 420*a*', 420*b*'. According to other embodiments, the inductors may have a meander, spiral or other appropriate pattern, for example.

Similarly, the opposing board segments 404*b*, 404*d* of the second dipole radiator 440*b* include patterned metallization (e.g., copper) on the front side of the board segments 404*b*, 404*d* and patterned metallization (e.g., copper) on the rear side of the board segments 404*b*, 404*d*. The patterned metallization on the front side of the board segments 404*b*, 404*d* includes first and second polygonal-shaped dipole arms 410*b*, 410*d* having through-openings 414 therein. The patterned metallization on the rear side of the board segments 404*b*, 404*d* includes a first pair of spaced-apart and polygonal-shaped dipole arms 420*a*, 420*b* having equivalent dimensions, and a second pair of spaced-apart and somewhat larger polygonal-shaped dipole arms 420*a*', 420*b*' having equivalent dimensions. As described herein and illustrated best by FIG. 5C, these pair of dipole arms 420*a*, 420*b*, and 420*a*', 420*b*' on the rear side of the PCB 404 function as dipole arm extensions relative to the first and second dipole arms 410*b*, 410*d*.

As shown, the first pair of spaced-apart and rear facing dipole arms 420*a*, 420*b* extend adjacent a distal end of the board segment 404*b* and the second pair of spaced-apart and rear facing dipole arms 420*a*', 420*b*' extend adjacent a distal end of the opposing board segment 404*d*. In addition, each of the rear facing dipole arms 420*a*, 420*b* extends opposite a corresponding and equivalent serpentine-shaped inductor 406*a*, 406*b*. Each of these inductors 406*a*, 406*b* is: (i) patterned on the front side of the board segment 404*b*, (ii) directly coupled (e.g., electrically shorted) via a short metal segment to a corresponding side of the first dipole arm 410*b*, as shown, and (iii) directly coupled by a corresponding plated through-hole 408*a*, 408*b* to an underlying one of the rear facing dipole arms 420*a*, 420*b* on the board segment 404*b*. Likewise, each of the rear facing dipole arms 420*a*', 420*b*' extends opposite a corresponding and equivalent serpentine-shaped inductor 406*a*, 406*b*. Each of these inductors 406*a*, 406*b* is: (i) patterned on the front side of the board segment 404*c*, (ii) directly coupled (e.g., electrically shorted) via a short metal segment to a corresponding side of the second dipole arm 410*c*, as shown, and (iii) directly coupled by a corresponding plated through-hole 408*a*, 408*b* to an underlying one of the rear facing dipole arms 420*a*', 420*b*' on the board segment 404*d*.

Referring now FIG. 5B and to the enlarged and highlighted portion of the board segment 404*a* of the first dipole radiator 440*a*, which is illustrated on the left side of FIG. 5A, each of the "primary" dipole arms 410*a*, 410*b*, 410*c* and 410*d* on the front sides of the corresponding board segments 404*a*, 404*b*, 404*c* and 404*d* partially overlaps a corresponding pair of underlying and rear facing dipole arms (420*a*,

420*b*) or (420*a*', 420*b*'), as shown best by FIG. 5C. As will be understood by those skilled in the art, this partial overlap defines pairs of equivalent capacitors "C" at the distal ends of each of the front facing dipole arms 410*a*, 410*b*, 410*c* and 410*d*. In FIG. 5A, the locations of these capacitors C are highlighted by the reference numbers 430*a*, 430*b*, whereas in FIG. 5B, the locations of the eight (i.e., 4 pairs) equivalent capacitors are identified by the reference "C". The amount of capacitance provided by these capacitors C is equivalent to: $C=\varepsilon A/d$, where ε and d are the electrical permittivity and thickness of the dielectric board 404, respectively, and A is the area of metal overlap between each of the front facing dipole arms 410*a*, 410*b*, 410*c* and 410*d* and underlying rear facing dipole arm (i.e., 420*a*, 420*b*, 420*a*', or 420*b*'). These built-in "overlap" capacitors C and the serpentine-shaped inductors (L) 406*a*, 406*b* each provide a radio frequency (f) dependent reactance X (e.g., resonant network), which "loads" the distal ends of the front facing dipole arms 410*a*-410*d*, where $X=((2\pi f)(C))^{-1}$ for each capacitor C and $X=((2\pi f)(L))$ for each inductor L. The built-in capacitors C and inductors L are illustrated and described herein as having equivalent capacitance values and equivalent inductance values, respectively, however alternative embodiments of the invention may utilize capacitors having unequal capacitance values and inductors having unequal inductance values.

Advantageously, this reactive loading of the front facing dipole arms 410*a*-410*d* can be utilized to support preferential operation of the mid-band radiating element 400 across multiple spaced-apart bands within the mid-band, such as, but not limited to, a relatively wide 1695-2690 MHz band and a narrower and nonoverlapping 1427-1518 MHz band, which is spaced from the 1695-2690 MHz band by an intermediate and "suppressed" band stemming from 1518 MHz to 1695 MHz.

Figure 6A:
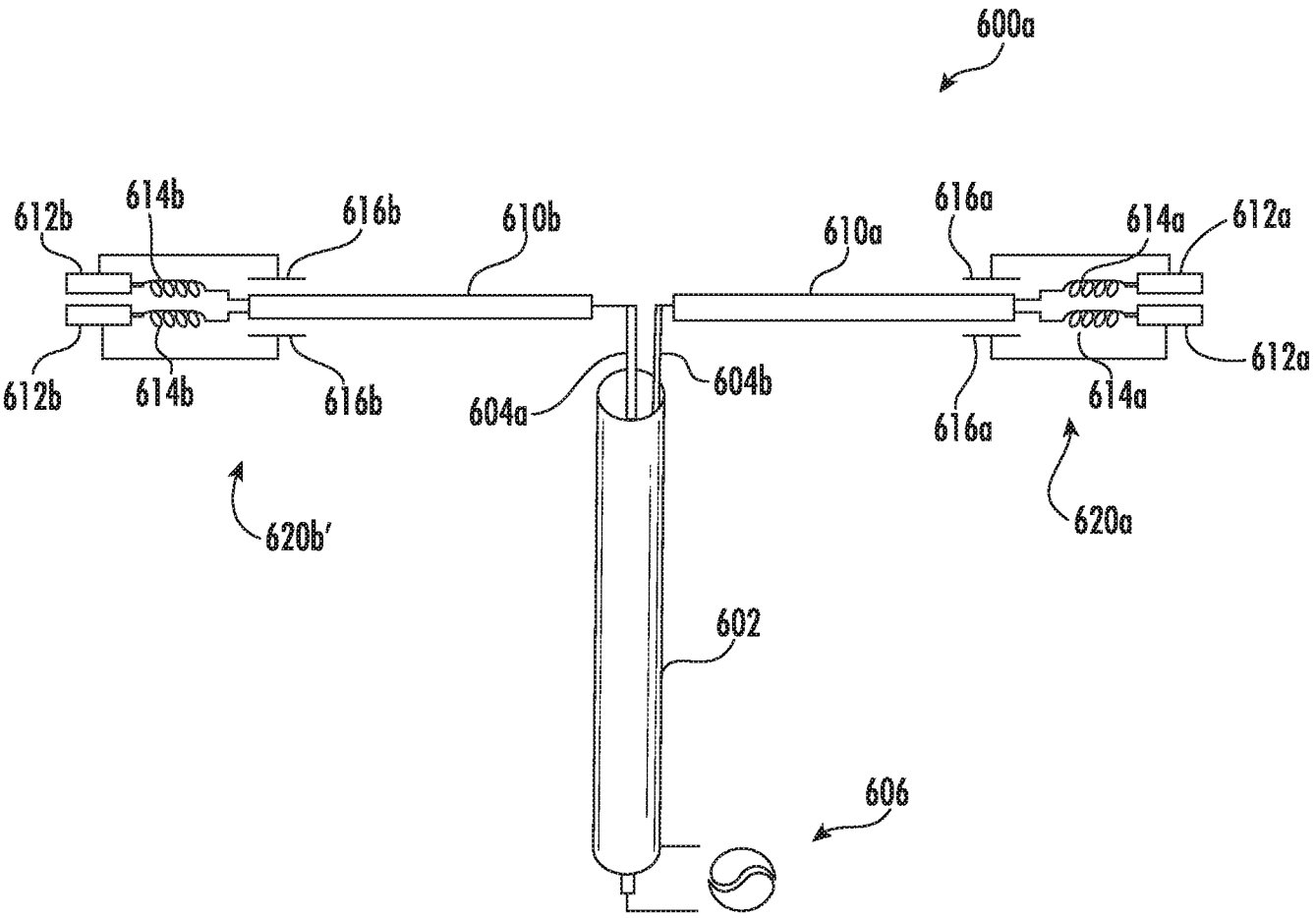
FIG. 6A is a highly simplified electrical schematic of a dipole antenna with front and rear facing dipole arms, and with an LC-based resonant circuit integrated therein.

The multi-band operation of the mid-band radiating element 400 of FIGS. 5A-5C can be more fully appreciated by considering the operation of a simplified electrical schematic of a dipole antenna, which has front and rear facing dipole arms and an integrated LC-based resonant circuit that is coupled to these front and rear facing dipole arms, as illustrated by FIG. 6A. In particular, FIG. 6A illustrates a simplified dipole antenna 600*a* containing right and left "front facing" radiating elements 610*a* and 610*b*, which are driven with radio frequency (RF) transmission signals (at frequency F0). These RF transmission signals are provided by an RF source 606 (e.g., a radio), and a coaxial cable 602 containing a central conductor 604*a* and surrounding shield layer 604*b*.

As further illustrated by FIG. 6A, the simplified dipole antenna 600*a* further includes a right reactive loading network 620*a*, which is coupled to a distal end of the right radiating element 610*a*, and a left reactive loading network 620*b*, which is coupled to a distal end of the left radiating element 610*b*. The right reactive loading network 620*a* includes two inductors 614*a* that are directly connected to the right radiating element 610*a*, and two right radiating element extensions 612*a* that are capacitively coupled to the distal end of the right radiating element 610*a* by two capacitors 616*a*. Each of these right radiating element extensions 612*a* is connected to a corresponding one of the inductors 614*a* and a corresponding one of the capacitors 616*a*, as shown. Similarly, the left reactive loading network 620*b* includes two inductors 614*b* that are directly connected to the left radiating element 610*b*, and two left radiating element extensions 612*b* that are capacitively coupled to the distal end of the left radiating element 610*b* by two capacitors 616*b*.

For purposes of illustration herein, the two right radiating element extensions 612*a* and the two left radiating element extensions 612*b* correspond to respective pairs of rear facing dipole arm extensions, such as arms 420*a*, 420*b* illustrated by FIGS. 5A, 5C. Likewise, the right and left inductor pairs 614*a* and 614*b* of FIG. 6A correspond to the inductor pairs 406*a* and 406*b* of FIG. 5A, and the right and left pairs of capacitors 616*a*, 616*b* of FIG. 6A correspond to the pair of capacitors C associated with opposing distal ends of the forward facing dipole arms 410*a*, 410*c* within the first dipole radiator 440*a* of FIGS. 5A-5C. Accordingly, it can be appreciated that the added L and C components and rear facing dipole arm extensions 420*a*, 420*b* of FIGS. 5A-5C can be modeled as approximate to the reactive loading networks 620*a*, 620*b* of FIG. 6A.

Figure 6B:
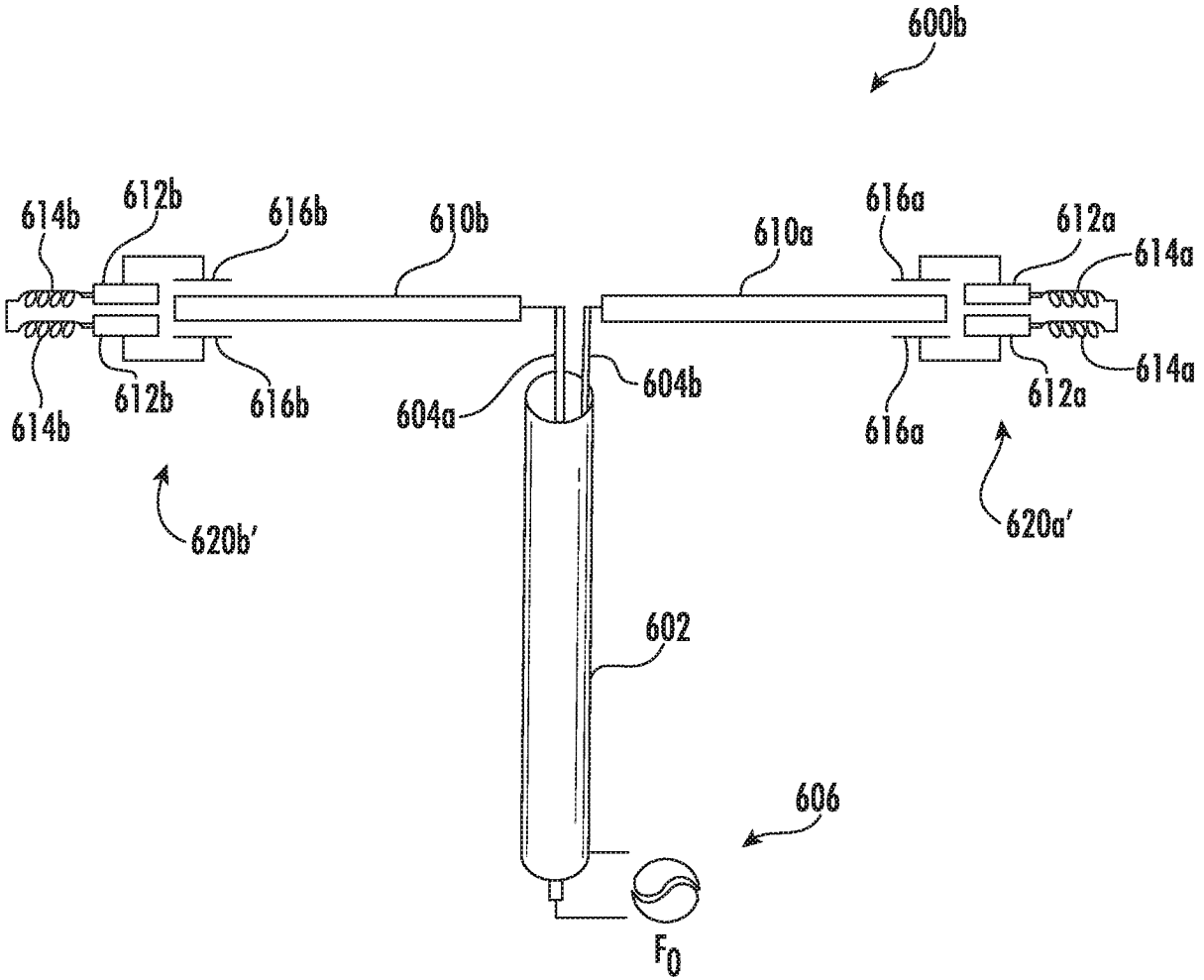
FIG. 6B is a highly simplified electrical schematic of a dipole antenna with front and rear facing dipole arms, and with a CLC-based resonant circuit integrated therein.

And, as illustrated by FIG. 6B, the reactive loading networks 620*a*, 620*b* of FIG. 6A, which show equivalent pairs of LC networks (in parallel) at the ends of each radiating element 610*a*, 610*b*, can be modified to include CLC networks within the reactive loading networks 620*a*', 620*b*', and these CLC networks can be applied to the first and second dipole radiators 440*a*, 440*b* of FIGS. 5A-5C.

Figure 5D:
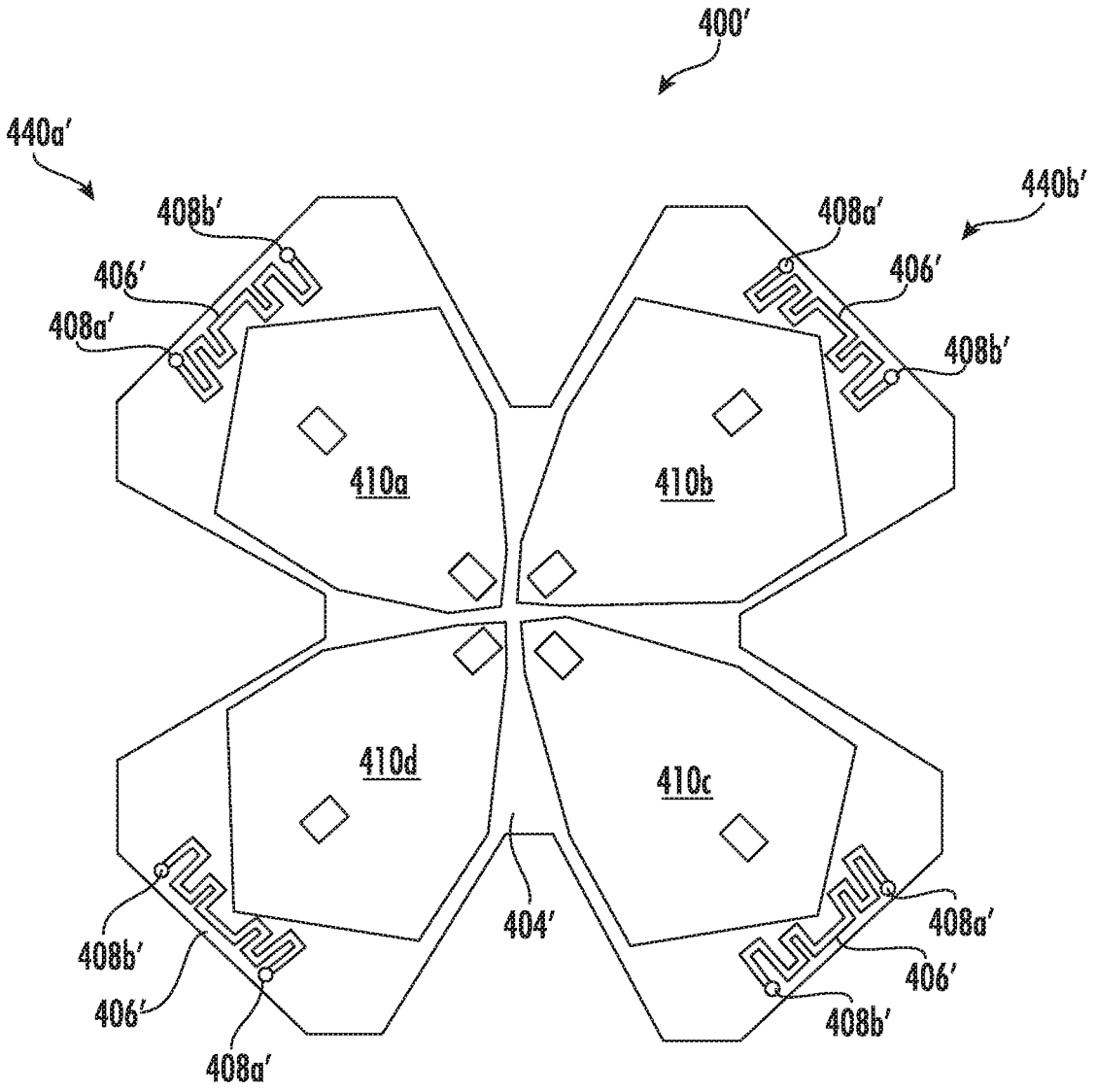
FIG. 5D is a front view of a printed circuit board that illustrates an alternative mid-band radiating element, according to an embodiment of the present invention.
Figure 5E:
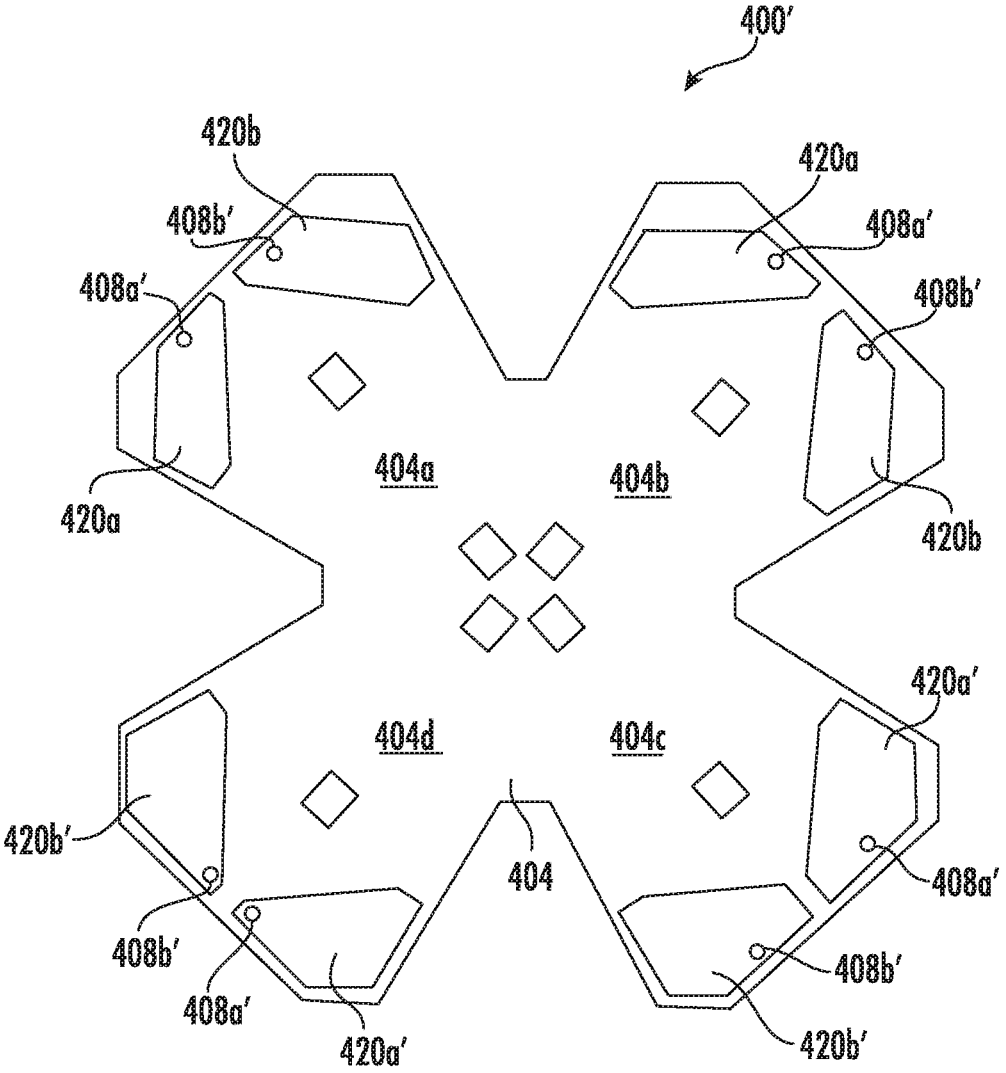
FIG. 5E is a front view of the printed circuit board of FIG. 5D, but with front side metallization removed and rear side metallization highlighted to illustrate placement and dimensions of four pairs of dipole arm extensions (and through-board interconnects) located on the rear side of the printed circuit board, according to an embodiment of the present invention.

For example, as shown by FIGS. 5D-5E, a mid-band radiating element 400' according to an alternative embodiment of the present invention may be configured so that the distal ends of each of the first and second polygonal-shaped dipole arms 410*a*, 410*c* in a first dipole radiator 440*a*' may be loaded by a corresponding CLC circuit. With respect to the first dipole arm 410*a*, a single serpentine-shaped inductor 406' is provided having a pair of terminals electrically connected (by through-board holes 408*a*', 408*b*') to corresponding dipole arm extensions 420*a*, 420*b*, on the rear side of the multi-layer PCB 404. These extensions partially overlap with the distal end of first dipole arm 410*a* to thereby define a pair of capacitors C that collectively form a CLC circuit with the corresponding inductor 406'. Similarly, with respect to the second dipole arm 410*c*, a single inductor 406' is provided having a pair of terminals electrically connected (by through-board holes 408*a*', 408*b*') to corresponding dipole arm extensions 420*a*', 420*b*', which partially overlap with the distal end of second dipole arm 410*c* to thereby define a pair of capacitors C that collectively form a series-CLC circuit with the corresponding inductor 406'. These same series-CLC circuit connections are also provided to the dipole arms 410*b* and 410*d* associated with a second dipole radiator 440*b*'.

Figure 7B:
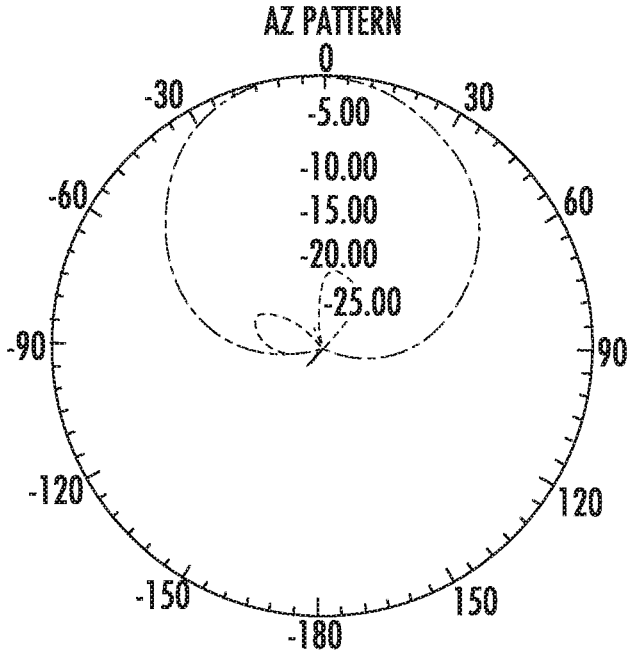
FIG. 7 illustrates azimuth-plane radiation patterns associated with the mid-band radiating element of FIGS. 5A-5C, for four frequencies spanning 1400 MHz to 2690 MHz. These four frequencies include 1400 MHz and 1600 MHz (FIG. 7A), and 2045 MHz and 2690 MHz (FIG. 7B).
Figure 7B:
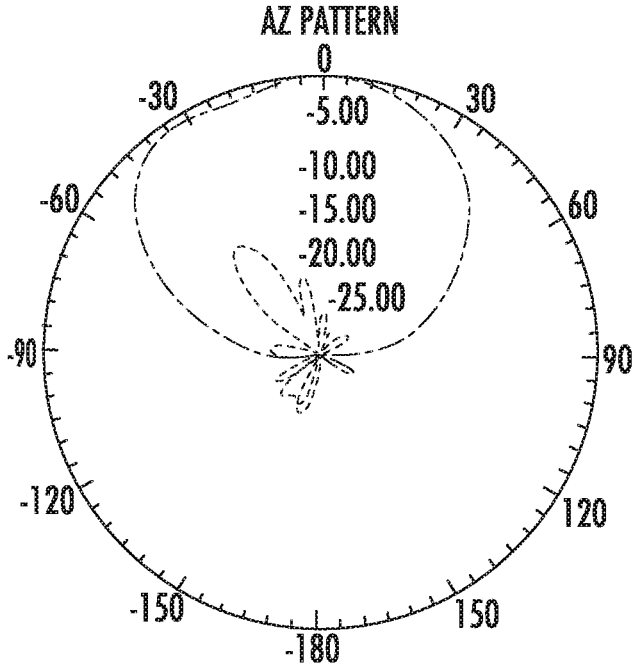

Finally, as illustrated by the four azimuth-plane radiation patterns of FIG. 7, which are simulations of the mid-band radiating element of FIGS. 5A-5C across a large mid-band frequency range extending from 1400 MHz to 2690 MHz, multi-band operation is demonstrated where the 1400 MHz, 2045 MHz and 2690 MHz radiation patterns show excellent profiles, whereas the intermediate 1600 MHz radiation pattern shows higher cross-polarization caused by the LC-circuit loading (i.e., low-pass filter effect) at the distal ends of the front facing dipole arms 410*a*, 410*c*.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

The which is claimed is:

1. A multi-band radiating element, comprising:

a first dipole radiator including first and second opposed dipole arms, said first and second dipole arms loaded at opposing distal ends thereof by respective first and second LC networks, which each have a first terminal capacitively-coupled to a corresponding one of said first and second dipole arms and a second terminal directly connected to a corresponding one of said first and second dipole arms;

wherein said first and second dipole arms are configured to resonate at a first frequency; and wherein the first and second LC networks are configured as low pass filters that preferentially block signals at the first frequency.

2. A multi-band radiating element, comprising:

a first dipole radiator including first and second opposed dipole arms, said first and second dipole arms loaded at opposing distal ends thereof by respective first and second LC networks, which each have a first terminal capacitively-coupled to a corresponding one of said first and second dipole arms and a second terminal directly connected to a corresponding one of said first and second dipole arms;

wherein said first dipole radiator comprises a multi-layer printed circuit board; wherein the first and second dipole arms comprise patterned metallization on a first side of the multi-layer printed circuit board; and wherein each of the first and second LC networks comprises patterned metallization on a second side of the multi-layer printed circuit board.

3. The radiating element of claim 2, wherein a portion of the patterned metallization associated with the first LC network extends opposite a corresponding portion of the patterned metallization associated with the first dipole arm; and wherein a portion of the patterned metallization associated with the second LC network extends opposite a corresponding portion of the patterned metallization associated with the second dipole arm.

4. The radiating element of claim 3, wherein each of the first and second LC networks comprises patterned metallization in the form of an inductor on the first side of the multi-layer printed circuit board.

5. The radiating element of claim 4, wherein the multi-layer printed circuit board has: (i) a first plated through-hole therein, which electrically connects a terminal of the inductor associated with the first LC network to a first portion of the patterned metallization on the second side of multi-layer printed circuit board, and (ii) a second plated through-hole therein, which electrically connects a terminal of the inductor associated with the second LC network to a second portion of the patterned metallization on the second side of multi-layer printed circuit board.

6. The radiating element of claim 3, wherein each of the first and second LC networks comprises a corresponding serpentine-shaped trace on the first side of the multi-layer printed circuit board, which operates as an inductor.

7. The radiating element of claim 6, wherein the multi-layer printed circuit board has: (i) a first plated through-hole therein, which electrically connects a terminal of the inductor associated with the first LC network to a first portion of the patterned metallization on the second side of multi-layer printed circuit board, and (ii) a second plated through-hole therein, which electrically connects a terminal of the inductor associated with the second LC network to a second portion of the patterned metallization on the second side of multi-layer printed circuit board.

8. The radiating element of claim 2, wherein a portion of the patterned metallization associated with the first LC network extends opposite a corresponding portion of the patterned metallization associated with the first dipole arm to thereby define a first capacitor of the first LC network; and wherein a portion of the patterned metallization associated with the second LC network extends opposite a corresponding portion of the patterned metallization associated with the second dipole arm to thereby define a second capacitor of the second LC network.

9. A multi-band radiating element, comprising:

a first dipole radiator comprising a multi-layer printed circuit board, a first dipole arm on a front side of the printed circuit board, and an LC network comprising: (i) a second dipole arm on a rear side of the printed circuit board, which is capacitively-coupled through the multi-layer printed circuit board to the first dipole arm, and (ii) an inductor having a first terminal electrically connected to the first dipole arm and a second terminal electrically connected to the second dipole arm.

10. A multi-band radiating element for a base station antenna, comprising:

a first dipole radiator configured to selectively radiate radio frequency (RF) signals within first and second spaced-apart frequency bands, yet selectively attenuate RF signals intermediate the high end of the first frequency band and the low end of the second frequency band, using a resonant circuit comprising at least one inductor and at least one capacitor disposed in series on said first dipole radiator, said at least one capacitor having a first electrode capacitively coupled to a first dipole arm of said first dipole radiator and a second electrode electrically connected in series with a first terminal of said at least one inductor, which has a second terminal electrically coupled by the resonant circuit to the first dipole arm.

* * * * *